US009803398B2

(12) United States Patent
Lai

(10) Patent No.: US 9,803,398 B2
(45) Date of Patent: Oct. 31, 2017

(54) COMBINATION PADLOCK WITH DUAL LOCKING AND ADVANCED ANTI-PICK MECHANISM

(71) Applicant: The Sun Lock Company Ltd., Tuen Mun, N.T. (HK)

(72) Inventor: Karl Lai, Tai Po (HK)

(73) Assignee: The Sun Lock Company Ltd., Tuen Mun, N.T. (HK)

( * ) Notice: Subject to any disclaimer, the term of this patent is extended or adjusted under 35 U.S.C. 154(b) by 45 days.

(21) Appl. No.: 14/953,663

(22) Filed: Nov. 30, 2015

(65) Prior Publication Data

US 2016/0222698 A1 Aug. 4, 2016

Related U.S. Application Data

(60) Provisional application No. 62/109,782, filed on Jan. 30, 2015.

(51) Int. Cl.

| | |
|---|---|
| ***E05B 67/06*** | (2006.01) |
| ***E05B 37/00*** | (2006.01) |
| ***E05B 67/00*** | (2006.01) |
| ***E05B 67/24*** | (2006.01) |
| ***E05B 37/02*** | (2006.01) |

(52) U.S. Cl.

CPC ..... *E05B 67/063* (2013.01); *E05B 37/0068* (2013.01); *E05B 37/025* (2013.01); *E05B 67/003* (2013.01); *E05B 67/24* (2013.01)

(58) Field of Classification Search

CPC .. E05B 67/063; E05B 37/0068; E05B 37/025; E05B 67/003; E05B 67/24

USPC ..... 70/21, 24–29, 284, 285

See application file for complete search history.

(56) References Cited

U.S. PATENT DOCUMENTS

| | | | | |
|---|---|---|---|---|
| 4,545,223 | A * | 10/1985 | Poutiainen | E05B 67/24 70/368 |
| 4,733,548 | A * | 3/1988 | Ling | E05B 37/025 70/25 |
| 5,394,711 | A * | 3/1995 | Pitkanen | E05B 9/086 70/368 |
| 5,715,709 | A | 2/1998 | Lai | |
| 6,029,481 | A | 2/2000 | Lai | |
| 6,035,672 | A | 3/2000 | Lai | |
| 6,164,096 | A | 12/2000 | Lai | |
| D439,824 | S | 4/2001 | Lai | |
| D439,825 | S | 4/2001 | Lai | |
| D448,273 | S | 9/2001 | Lai | |

(Continued)

FOREIGN PATENT DOCUMENTS

| | | |
|---|---|---|
| CN | 2682167 | 3/2005 |

*Primary Examiner* — Suzanne Barrett

(74) *Attorney, Agent, or Firm* — Ware, Fressola, Maguire & Barber LLP

(57) ABSTRACT

A padlock is provided that can be locked and unlocked using a combination mechanism or a key mechanism. A padlock includes clutches that will not be turned during the lock mode or the open mode. A lock body has more than one slot to engage an extended fin of the clutch in the lock mode. An opening slot and faulty notches are located in each of the dials. In the lock mode, the turning of the dials will have no effect on the clutches. Each extended fin of the clutch is engaged in a slot of the lock body in the lock mode. The faulty notches on the dials are clearer and an intruder cannot feel the correct opening slot by turning dials to pick the combination.

9 Claims, 8 Drawing Sheets

(56) References Cited

U.S. PATENT DOCUMENTS

| | | | | |
|---|---|---|---|---|
| D451,002 | S | 11/2001 | Lai | |
| 6,408,660 | B1 | 6/2002 | Lai | |
| 6,474,116 | B1 | 11/2002 | Lai | |
| D472,790 | S | 4/2003 | Lai | |
| 6,675,614 | B2 | 1/2004 | Lai | |
| 6,729,166 | B1 | 5/2004 | Lai | |
| 6,742,366 | B1 | 6/2004 | Lai | |
| D498,132 | S | 11/2004 | Lai | |
| 6,883,355 | B2 | 4/2005 | Lai | |
| D511,673 | S | 11/2005 | Lai | |
| 7,117,698 | B2 | 10/2006 | Lai | |
| 7,140,209 | B2 | 11/2006 | Lai | |
| 7,225,648 | B2 | 6/2007 | Lai et al. | |
| 7,269,985 | B2 | 9/2007 | Lai et al. | |
| 7,467,529 | B1 | 12/2008 | Lai et al. | |
| 7,467,531 | B2 | 12/2008 | Lai et al. | |
| 7,562,545 | B2 | 7/2009 | Lai et al. | |
| 7,685,851 | B2 | 3/2010 | Lai | |
| 7,765,840 | B2 | 8/2010 | Lai et al. | |
| 8,096,150 | B2 | 1/2012 | Lai et al. | |
| 8,261,583 | B2 | 9/2012 | Lai et al. | |
| 8,511,118 | B2 | 8/2013 | Lai et al. | |
| 8,640,507 | B1 * | 2/2014 | Derman | E05B 67/06 70/14 |
| 8,661,861 | B2 | 3/2014 | Lai | |
| 8,776,556 | B2 | 7/2014 | Lai | |
| 8,826,703 | B2 | 9/2014 | Lai | |
| 8,931,313 | B2 | 1/2015 | Lai | |
| 9,556,650 | B1 * | 1/2017 | Lai | E05B 37/025 |
| 2005/0044901 | A1 * | 3/2005 | Yu | E05B 35/105 70/25 |
| 2005/0155395 | A1 | 7/2005 | Yu | |
| 2008/0066500 | A1 | 3/2008 | Su | |
| 2013/0118215 | A1 * | 5/2013 | Lai | E05B 37/0034 70/21 |
| 2016/0102476 | A1 * | 4/2016 | Lai | E05B 37/025 70/25 |

* cited by examiner

COMBINATION PADLOCK WITH DUAL LOCKING AND ADVANCED ANTI-PICK MECHANISM

CROSS-REFERENCE TO RELATED APPLICATIONS

The present application claims the benefit of U.S. Provisional Patent Application No. 62/109,782, filed Jan. 30, 2015, which is hereby incorporated by reference in its entirety.

BACKGROUND OF THE INVENTION

The combination padlock developed by applicant and described in U.S. Pat. No. 7,117,698 titled "High Security Padlock Construction", is one of the most secure padlocks for mid-size combination padlocks. However, in today's market, people would like to have a more secure combination mechanism and also a secondary mechanism, such as a key overriding mechanism to open the combination padlock. This is particularly applicable to the cycle lock market (i.e., bicycles and bikes) because the value of the bicycle and bike is high, which increases the demand for a higher security level of combination padlock and a combination padlock which has a better anti-pick mechanism. There is also a demand for a padlock having a secondary opening mechanism, as users can have a choice of using a combination and/or a key mechanism to open the lock without having trouble finding the key or remembering the code. The present invention of a novel combination padlock addresses these needs in the art by improving the anti-pick mechanism and providing a key mechanism to override the combination mechanism to open the lock without difficulty.

In the mechanisms of the padlock shown in applicant's U.S. Pat. No. 7,117,698, all of the extended fins of the clutches align to the lock opening slot of the lock body and with that, the spindle can then be pushed upward. The extended fins of the clutches engage the teeth of the dials in the lock mode, which makes the clutch turn as the dial turns in the lock mode. The drawback of this lock is that it will be difficult to make the faulty notches in the lock body with this setup because it is very time consuming and costly to make the faulty notches in the lock body. Additionally, a button is required to be pushed for opening the padlock. This may allow an intruder to attempt to use a hammer to break and open the lock. The present invention further addresses these shortcomings of the art.

SUMMARY OF THE INVENTION

According to the present invention, a padlock is provided having a combination locking mechanism and a key locking mechanism. The padlock includes a lock body, a cable connected to a combination side cable end and a key side cable end, a spindle to control the locking and unlocking of the combination locking mechanism independent of the key locking mechanism, more than one clutch mounted on the spindle which control the vertical movement of the spindle, more than one dial mounted in the lock body, each dial having an opening slot and faulty notches, a bolt in contact with the combination side cable end and having its movement controlled by the movement of the spindle, a cam comprising a slot, and a cylinder comprising a fork to contact the slot of the cam such that the rotational movement of the cylinder transfers to the cam.

According further to an embodiment of the padlock of the present invention, the faulty notches of each dial prevent picking the padlock, and the opening slot of each dial receives an extended fin of the clutch. The lock body may further include a number of slots to receive the extended fin of the clutch, with the number of slots in the lock body being equal to a number of indicia on each dial.

According to a further embodiment of the padlock of the present invention, the spindle comprises a top portion which contacts a neck of the bolt. The spindle may further comprise a threaded end to receive a threaded end of a reset button. The spindle may also comprise a hole to receive a ball to hold the spindle and reset button together to allow the reset button to unwind partially out of the lock body and to allow the user to pull a knob area of the reset button downward during a combination reset mode.

According to a further embodiment of the padlock of the present invention, the bolt may include a tip area which contacts a groove of the combination side cable end. The bolt may further comprise a neck which contains a slope contacting a top portion of the spindle. The horizontal movement of the bolt may be controlled by the relationship between the slope of the bolt and the top portion of the spindle. The horizontal movement of the bolt may also be controlled by the movement of the spindle, such that if the clutch and dial are in a locked position, the spindle is in a locked position and the spindle and bolt will have no movement and will lock the bolt and the combination side end cable together, and if an extended fin of the clutch aligns with the opening slot of the dial, then the spindle is in an open position and can move vertically and allow the bolt to move horizontally to disengage with the groove of the combination side cable end. The cam may comprise a flat side and if the flat side of the cam aligns with the ball, then the ball can move toward the flat side and allow the groove of the key side cable end to disengage and release the cable end. The cam may further comprise a round side which prevents movement of the ball and will forces the ball to engage with the groove of the key side cable end.

DETAILED DESCRIPTION OF THE FIGURES

Figure 1A:
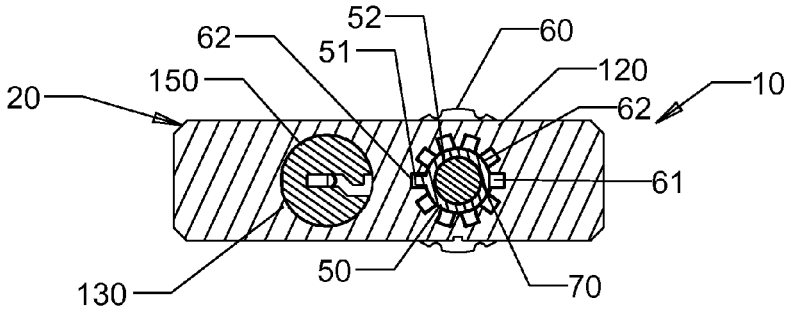
FIG. 1A shows a cross-sectional view along axis A-A of the padlock according to the present invention.
Figure 1B:
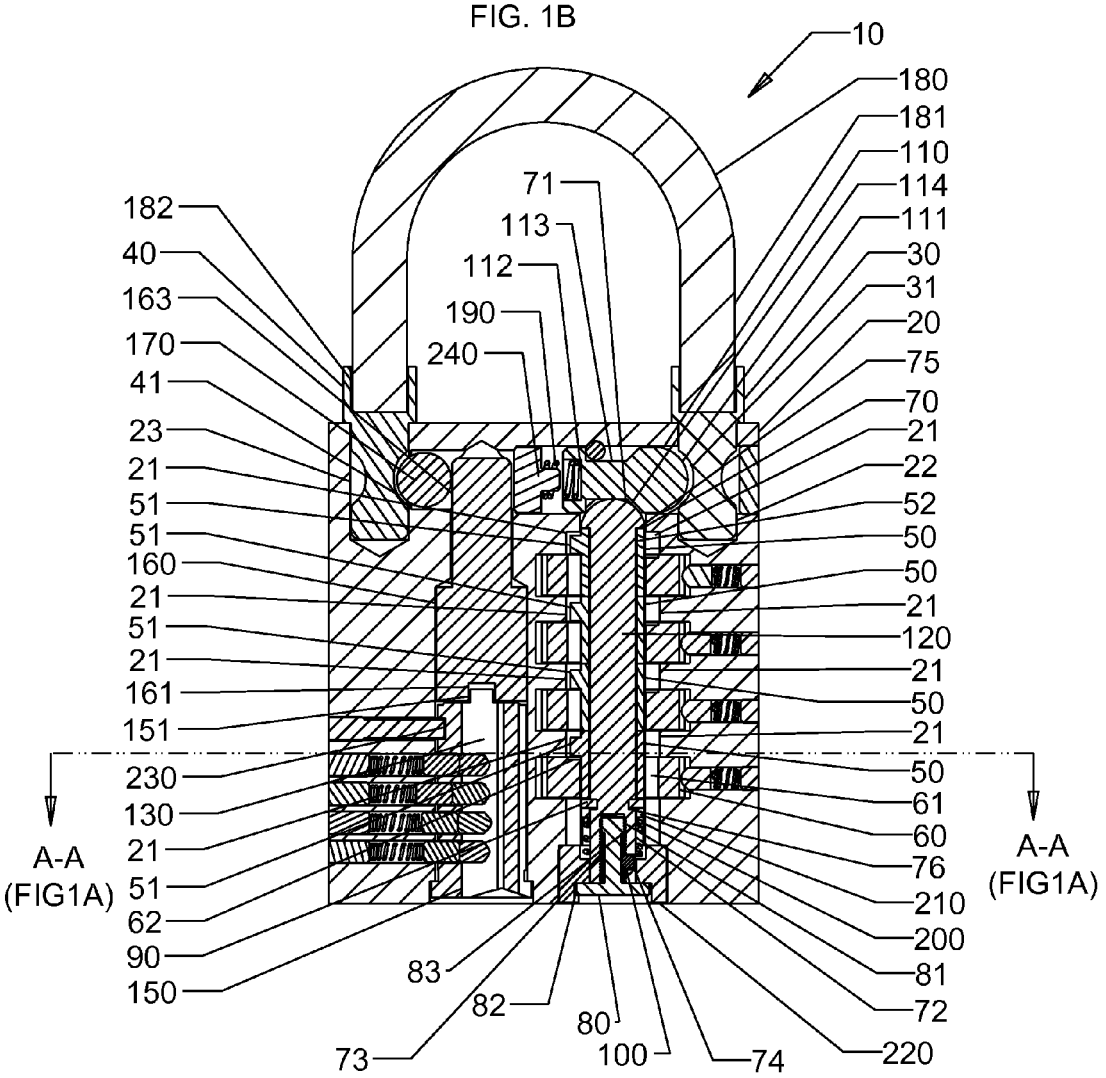
FIG. 1B shows a cross-sectional view of the padlock according to the present invention in the locked mode.
Figure 2A:
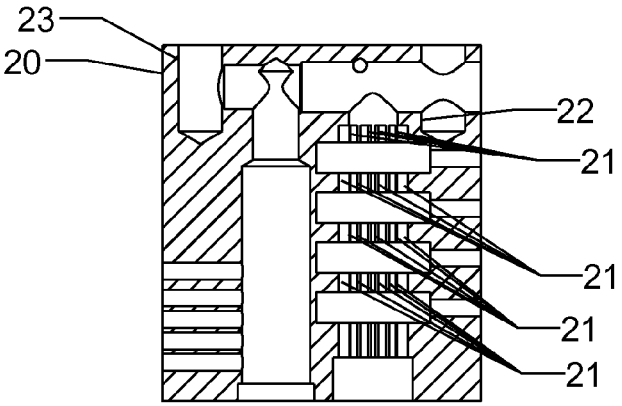
FIG. 2A shows a cross-sectional view of the lock body of the padlock according to the present invention.
Figure 2B:
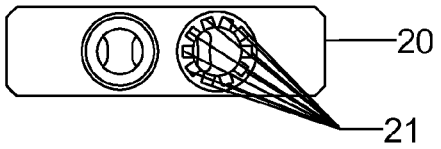
FIG. 2B shows a first, end view of the lock body of the padlock according to the present invention.
Figure 2C:
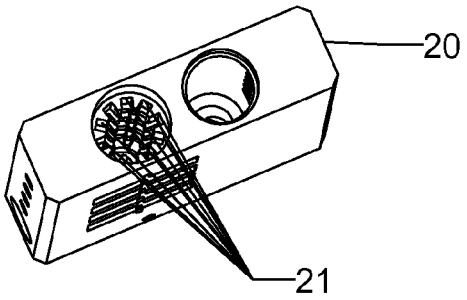
FIG. 2C shows a second, perspective view of the lock body of the padlock according to the present invention.
Figure 3:
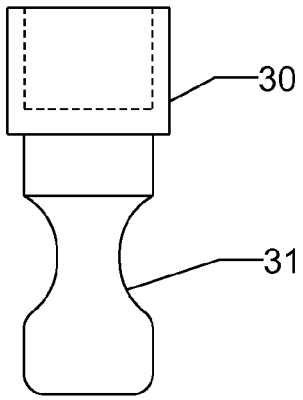
FIG. 3 shows the combo-cable end of the cable of the padlock according to the present invention.
Figure 4:
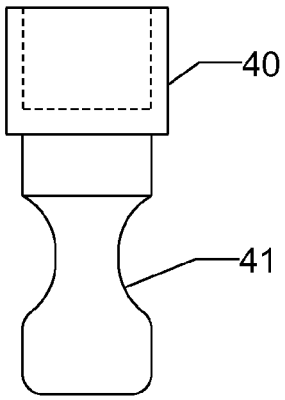
FIG. 4 shows the key-cable end of the cable of the padlock according to the present invention.
Figure 5:
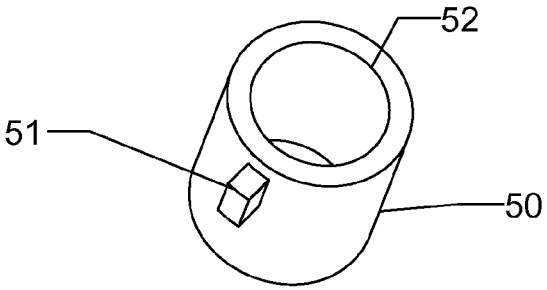
FIG. 5 shows a clutch of the padlock according to the present invention.
Figure 6A:
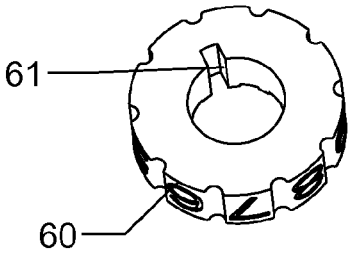
FIG. 6A shows a first, bottom perspective view of a dial of the padlock according to the present invention.
Figure 6B:
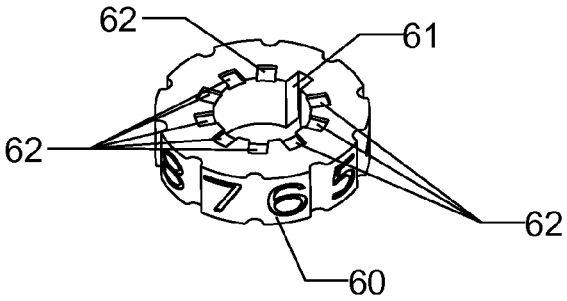
FIG. 6B shows a second, top perspective view of a dial of the padlock according to the present invention.
Figure 7A:
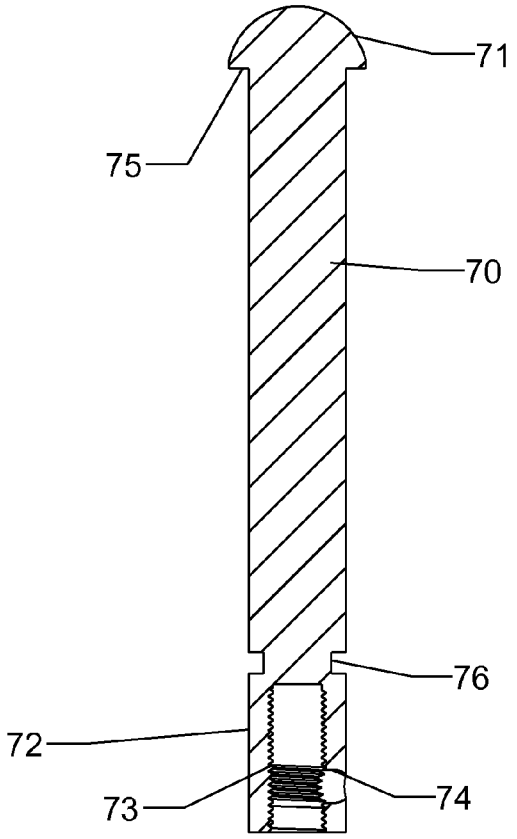
FIG. 7A shows a cross-sectional view of the spindle of the padlock according to the present invention.
Figure 7B:
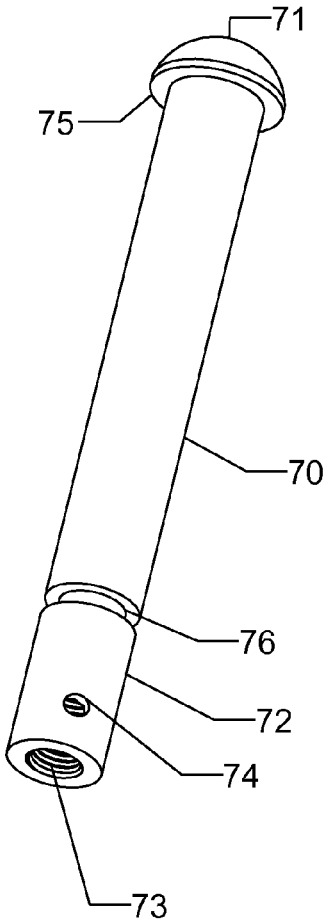
FIG. 7B shows a perspective view of the spindle of the padlock according to the present invention.
Figure 8:
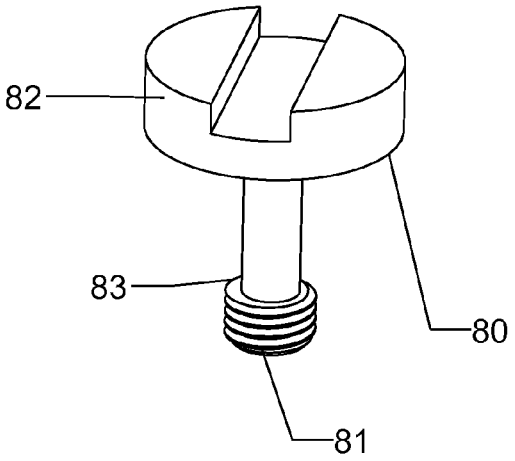
FIG. 8 shows a reset button of the padlock according to the present invention.
Figure 9:
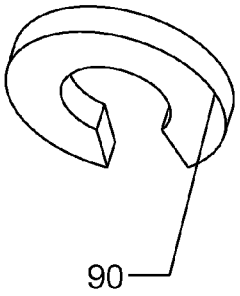
FIG. 9 shows a C-clip of the padlock according to the present invention.
Figure 10:
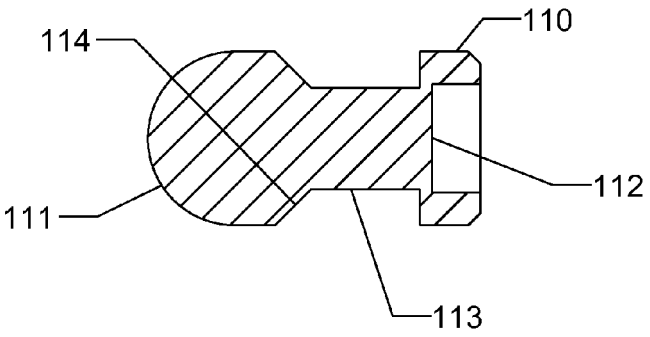
FIG. 10 shows a bolt of the padlock according to the present invention.
Figure 11:
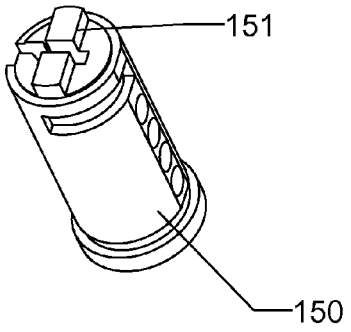
FIG. 11 shows a cylinder of the padlock according to the present invention.
Figure 12A:
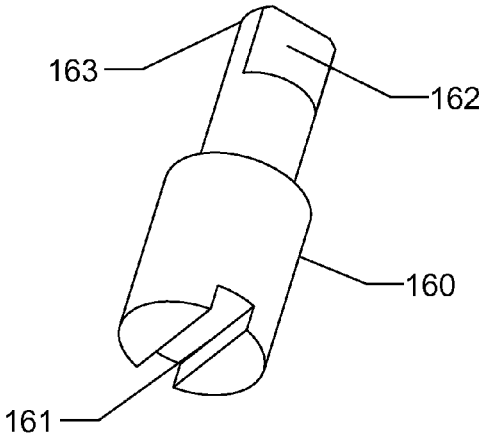
FIG. 12A shows a first, bottom perspective view of the cam of the padlock according to the present invention.
Figure 12B:
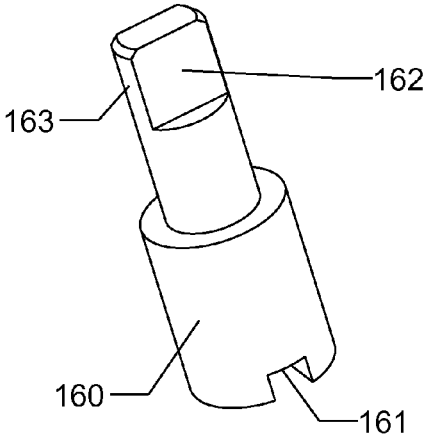
FIG. 12B shows a second, top perspective view of the cam of the padlock according to the present invention.
Figure 13:
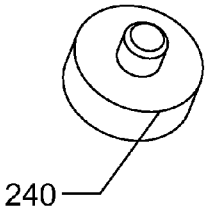
FIG. 13 shows a bolt spring plug of the padlock according to the present invention.
Figure 14:
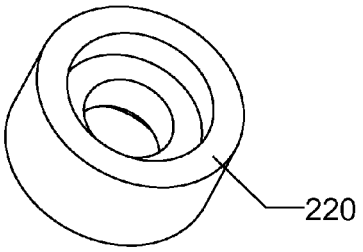
FIG. 14 shows a bottom seal cap of the padlock according to the present invention.

The present invention will now be described in reference to the Figures. The invention relates to a padlock 10 that can be locked and unlocked using a combination mechanism 120 or a key mechanism 130.

The present invention overcomes the shortcomings of the art in part by providing clutches 50 that will not be turned during the lock mode or the open mode. The lock body 20 has more than one slot 21 to engage the extended fin 51 of the clutch 50 in the lock mode. An opening slot 61 is located in each of the dials 60 and faulty notches 62 are also located in each of the dials 60. Manufacturing the dials 60 with an opening slot 61 and faulty notches 62 in the dials 60 is advantageous because it is more cost effective due to the current die-cast technology. Further, in the lock mode, the turning of the dials 60 will have no effect on the clutches 50, which means that an intruder cannot peek the extended fins 51 of the clutches 50 to align all clutches 50 in the same manner to open the padlock 10 according to the present invention. Each extended fin 51 of the clutch 50 is engaged in a slot 21 of the lock body 20 in the lock mode. The faulty notches 62 on the dials 60 are clearer and the intruder cannot feel the correct opening slot 61 by turning dials 60 to pick the combination.

The padlock 10 of the invention does not require a push button like the padlock described in U.S. Pat. No. 7,117,698, which is connected to the spindle. In the present invention, when all dials 60 are in the correct combination, the user can simply pull the combo-cable-end 30 out of the lock body 20. With the padlock 10 according to the present invention, the intruder has nothing to hit that can force open the combo-cable-end 30.

In the reset mode, the user needs to unwind the reset button 80 and then pull the reset button 80 downward. As the reset button 80 is being pulled downward, the extended fin 51 of the clutch 50 will be fully engaged to the opening slot 61 of the dial 60. The user can the turn the dials 60 to reset the code. Each dial 60 has at least one faulty notch 62 which helps to increase the difficulty of a picking the correct combination, making the padlock 10 harder to pick. The clutches 50 are assembled onto the spindle 70 with a C-clip 90 being inserted to hold them together. The clutches 50 each include a hole 52 that allows the spindle 70 to pass through the clutches 50. The end 72 of the spindle 70 includes threading 73 to receive the threaded end 81 of reset button 80. There is a hole 74 on the end 72 of the spindle 70 to receive a ball 100 placed in between the threaded end 81 of the reset button 80 and the threading 73 of the spindle 70, allowing the reset button 80 to be unwound partially out of the lock body 20 without being fully pulled out of the padlock 10. Such mechanism is very convenient and provides advantages over the art because the present invention does not have a button exposed, thus improving locking strength of the padlock 10 during a hammer strike and reducing the chances of being forced open by a hammer. The user in the reset mode can unwind the reset button 80 to allow the reset button 80 to move downward to give the user enough grip to pull the reset button 80 downward without the reset button 80 being fully pulled away from the lock body 20.

The new combination padlock 10 contains a primary mechanism, which is the combination mechanism 120. The combination mechanism 120 has no button to be pushed or pulled to open the padlock 10. Once a correct combination is aligned, the user can pull combo-cable-end 30 upward, away from the lock body 20, to open the padlock 10 via combination mechanism 120. Unlike the padlock described in U.S. Pat. No. 7,117,698, which requires the button to push upward, this new combination mechanism 120 does not require a button to push or pull for the lock open mode, which improves the locking strength during the lock in the hammer strike.

The newly developed combination padlock 10 contains a secondary mechanism, which is the key mechanism 130, allowing the user to use a secondary opening device such as a key 140 to open the padlock 10. Once the correct key cut of the key 140 is inserted into the cylinder 150, the fork 151 of the cylinder 150 will contact the slot 161 of the cam 160. As the cylinder 150 turns, the cam 160 will turn in the same manner, causing the flat side 162 of the cam 160 to align with the locking ball 170, which allows the user to pull the key-cable-end 40 away from the lock body 20. The secondary mechanism is great for the bicycle lock market, for example, as the user may forget their combination and can still open the padlock via key operated mechanism.

Locked Mode (FIG. 1A-14):

The cable 180 has two ends that are securely affixed together. One cable end is attached to the combo side 181 of the cable, is controlled by the combination mechanism 120, and is called a combo-cable-end 30. The other end of the cable 180 is attached to the key side 182 of the cable 180 and is controlled by the key locking mechanism 130, and is called the key-cable-end 40. In the lock mode, the grooves 31 of combo-cable-end 30 are securely engaged with the round-edge 111 of the bolt 110. The bottom 112 of the bolt 110 engages a spring 190 pushing the bolt 110 towards the groove 31 of the combo-cable-end 30, which will bias the round-edge 111 of the bolt 110 to engage the groove 31. A bolt spring plug 240 is positioned on the opposite end of the spring 190, so that the bolt spring plug 240 has an opposing surface to push against to bias the bolt 110 towards the groove 31 of the combo-cable end 30. The bolt 110 has a neck 113 which is engaged to the top 71 of the spindle 70. The clutches 50 are positioned on the spindle 70 along its length in between the wall 75 and the cut-out 76 of the spindle 70. The cut-out 76 of the spindle 70 receives a C-clip 90 being inserted to fasten the clutches 50 positioned on the spindle 70. With the clutches 50 placed along the spindle 70, the vertical movement of the spindle 70 is controlled by the alignment of the extended fins 51 of the clutches 50 and the opening slots 61 of the dials 60.

In the lock mode, the clutches 50 are not aligned with the lock open code, which means the extended fins 51 of the clutches 50 are not aligned with the lock opening slots 61 of the dials 60. Therefore, the spindle 70 cannot move downward. Because the spindle 70 cannot move downward, the top 71 of the spindle 70 remains engaged to the neck 113 of the bolt 110, which restricts the bolt 110 from moving. In the lock mode, when someone pulls the combo-cable-end 30 upward, the bolt 110 cannot move backward and therefore, the round-edge 111 of the bolt 110 remains engaged to the grooves 31 of the combo-cable-end 30. This prevents the combo-cable-end 30 from being pulled away from the lock body 20. Hence, the padlock 10 is securely locked by the combination mechanism 120.

Furthermore, each dial 60 contains an opening slot 61 and faulty notches 62. In the lock mode, at least one extended fin 51 from a clutch 50 is not in alignment with the opening slot 61 of the corresponding dial 60, and the entire padlock 10 cannot be opened. It is difficult for an intruder to peek at the extended fin 51 of the clutch 50, as the extended fin 51 is in the slot 21 of the lock body 20.

The intruder is also unable to pick the padlock 10 because the dials 60 contain the faulty notches 62, making it hard to feel the correct opening slot 61 and increasing the time required to pick the padlock 10, which improves the lock security level.

The padlock 10 also contains the key locking mechanism 130, which is controlled by the cylinder 150. If there is no key 140 (i.e., no correctly cut key) inserted into the cylinder 150, the cylinder 150 cannot be turned. As the cylinder 150 is engaged with the cam 160, the cam 160 cannot be turned and the locking ball 170 remains in contact with the locking surface 163 of the cam 160. This causes the groove 41 of the key-cable-end 40 to remain in locking position, restricting people from pulling the key-cable-end 40 to open the padlock 10. Hence, the padlock 10 is also secured by the key locking mechanism 130.

Figure 15A:
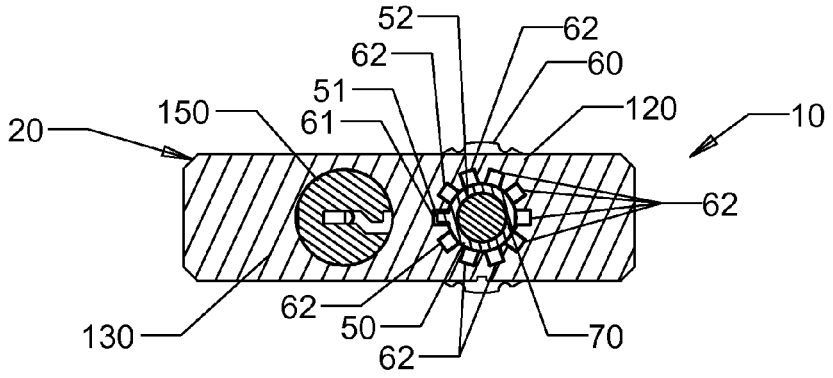
FIG. 15A shows a cross-sectional view along axis B-B of the padlock according to the present invention.
Figure 15B:
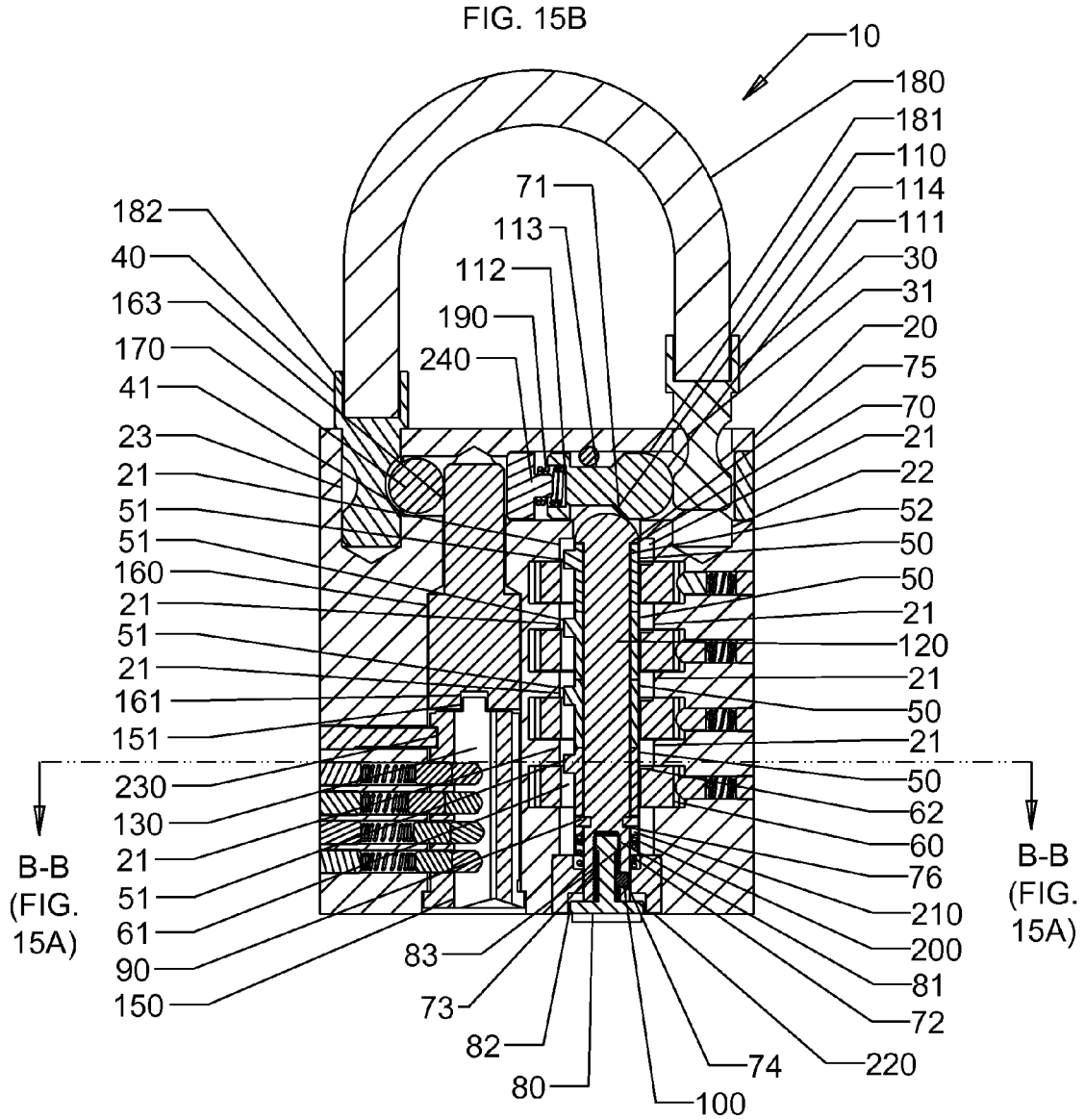
FIG. 15B shows a cross-sectional view of the padlock according to the present invention in the lock-open mode when unlocked by the correct combination.

Unlock by Combination Code (FIG. 15A-15B):

The extended fins 51 of the clutches 50 are each positioned in the one of the slots 21 of the lock body 20. There are enough slots 21 of the lock body 20 for each indicium, such as a number, character or word related to the dial 60. For example, if the dial 60 has ten digits (0-9), then there are ten slots 21 for the lock body 20 to receive the extended fin 51 of the clutches 50. When the dials 60 are aligned to the lock-open code, the extended fin 51 of the clutches 50 will align with the opening slots 61 of the dials 60.

The neck 113 of the bolt 110 has a sloped edge 114, which contacts the top 71 of the spindle 70. When the user pulls the combo-cable-end 30 for unlocking the padlock 10, the groove 31 of the combo-cable-end 30 will contact the round-edge 111 of the bolt 110, which will force the bolt 110 backwards (towards the spring 190). As the bolt 110 moves backward, the sloped edge 114 of the bolt 110 pushes against the top 71 of the spindle 70, which causes the spindle 70 to move downward (i.e., away from the bolt 110). As the extended fins 51 of clutches 50 align with the opening slots 61 of the dials 60, the spindle 70 will be pushed by bolt 110, and hence the spindle 70 moves downward. As the spindle 70 moves downward, the bolt 110 can travel further backward until the groove 31 of combo-cable-end 30 completely disengages with the round edge 111 of the bolt 110. The combo-cable-end 30 is released out of the combo-side locking hole 22 of the lock body 20.

In the unlock combination mode, the extended fins 51 of the clutches 50 have some portion in the slots 21 of the lock body 20 and some portion of the extended fins 51 will be in the opening slots 61 of the dial 60. In this position, the user cannot rotate the dials 60 in the lock-open mode by the combination, which improves the stability and gives the user a definite feeling that the combination for the padlock 10 will not be easily inadvertently recoded.

Figure 17A:
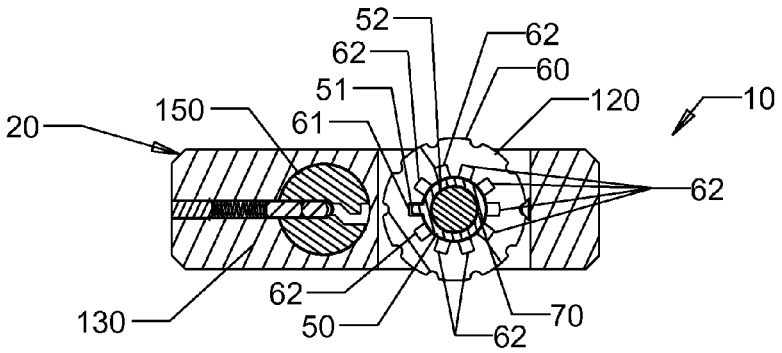
FIG. 17A shows a cross-sectional view along axis D-D of the padlock according to the present invention.
Figure 17B:
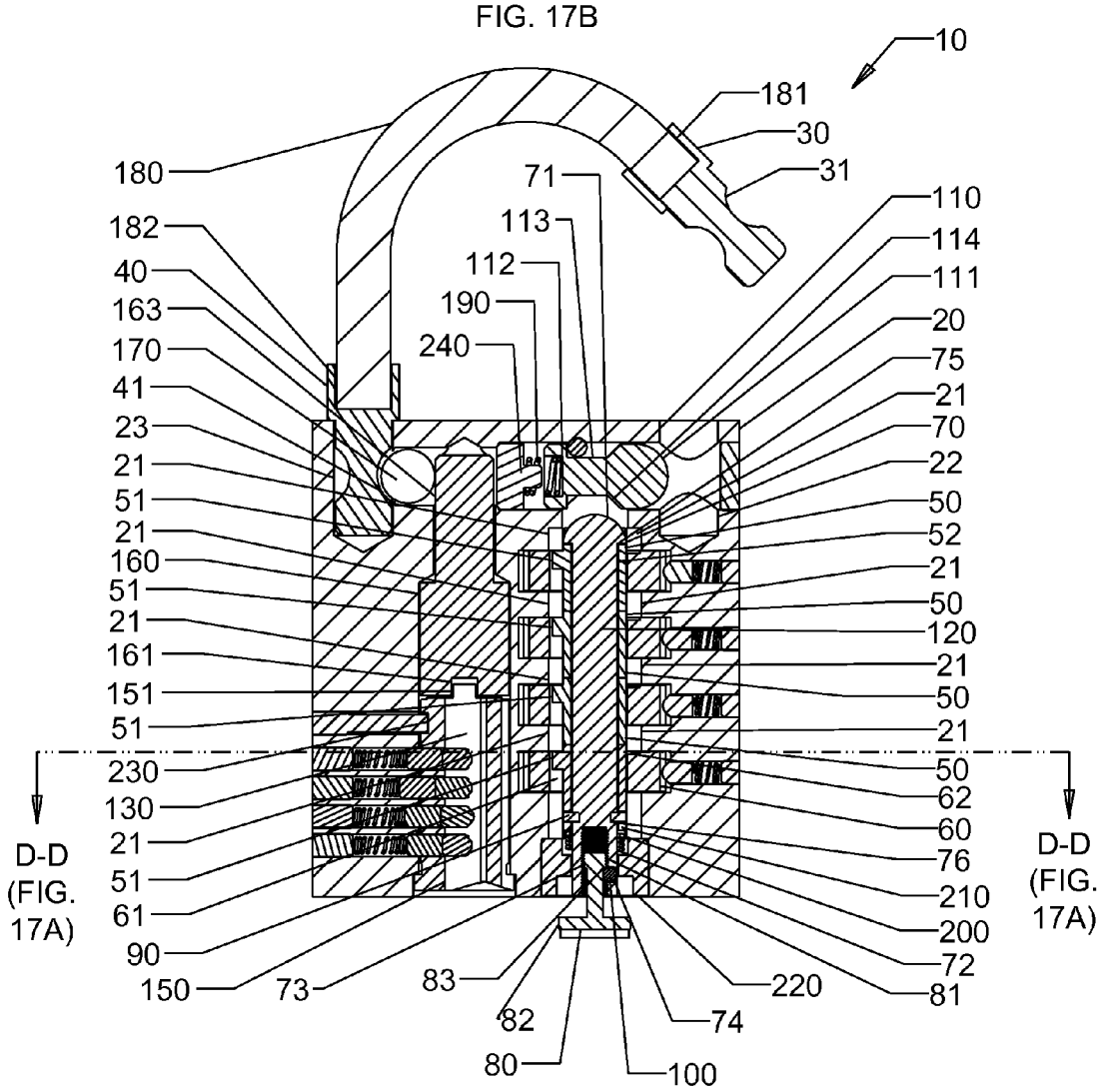
FIG. 17B shows a cross-sectional view of the padlock according to the present invention in the combination reset mode.

Reset Combination by Combination User (FIG. 17A-17B):

When the padlock 10 is opened by the correct combination, the spindle 70 is allowed to move vertically, as a result of the alignment of the extended fins 51 of the clutches 50 and the opening slots 61 of the dials 60 as described in the lock-open-mode.

In the reset mode, the user can unwind the reset button 80, and the knob area 82 of the reset button 80 can be extended outward from the lock body 20, which provides the user a better grip to pull the knob area 82 of the reset button 80 further downward. The reset button 80 is secured in between the spindle 70 by ball 100 inside of the spindle 70 which restricts the reset button 80 from fully unwinding and pulling away from the spindle 70. The side hole 74 of the spindle 70 is press fitted, which means the ball 100 is permanently affixed inside of the end 72 of the spindle 70. The user can unwind the reset button 80 until the stop-end surface 83 of the reset button 80 contacts the ball 100, which stops the reset button 80 from being fully pulled away from the spindle 70.

A separation ring 210 is placed underneath the C-clip 90, and a spindle spring 200 will be placed in between the separation ring 210 and the bottom seal cap 220. With such a setting, the spindle spring 200 will always push the separation ring 210 and the spindle 70 upward. Therefore, the user must pull the spindle 70 downward which pulls the extended fin 51 of the clutches 50 downward such that the extended fins 51 will be fully engaged to the opening slots 61 of the dials 60 and the extended fins 51 will be fully disengaged from the slot 21 of the lock body 20 during the entire reset mode. In such a position, the user can then turn the dials 60, and such rotational movement will rotate the extended fin 51 of the corresponding clutch 50 in the same manner. The user can turn the dials 60 to his/her desired code. This means that the extended fin 51 of the clutch 50 may turn to a different alignment of the slot 21 of the lock body 20. After setting the combination, the user can release the reset button 80, and the spindle spring 200 will push the spindle 70 upward. As the spindle 70 pushes back upward, the extended fins 51 of the clutches 50 will move away from the opening slot 61 of the dial 60, and move upward to the slot 21 of the lock body 20. The extended fins 51 will fully engage the slots 21 of the lock body 20 and will fully disengage from the opening slots 61 of the dials 60. The user can then wind up the reset button 80, and the reset button 80 will not extend out of the lock body 20 to further protect the reset button 80.

Figure 16A:
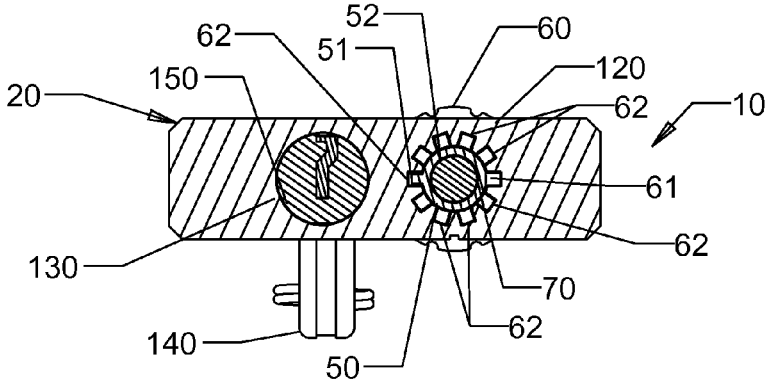
FIG. 16A shows a cross-sectional view along axis C-C of the padlock according to the present invention.
Figure 16B:
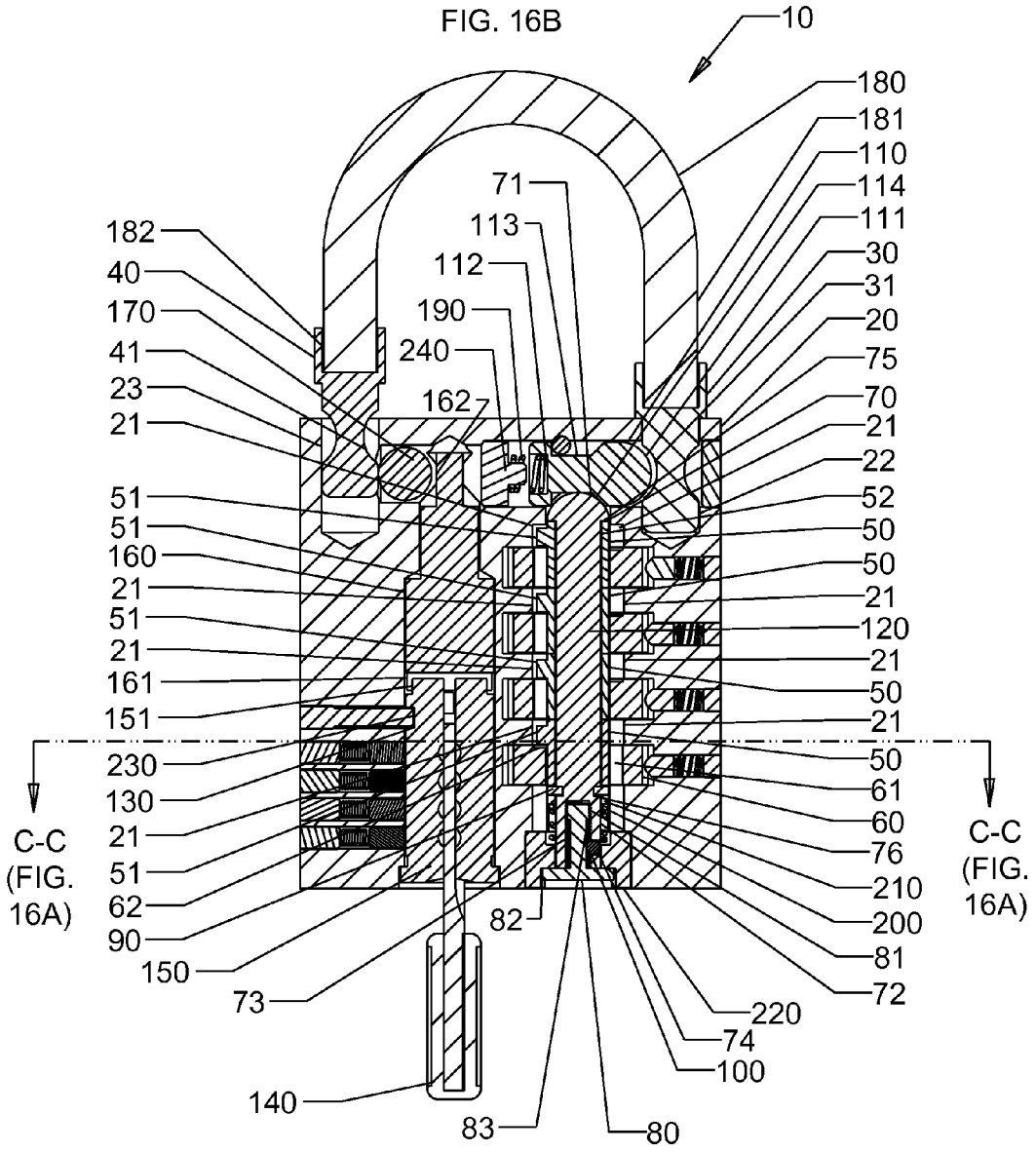
FIG. 16B shows a cross-sectional view of the padlock according to the present invention in the lock-open mode when unlocked by the correct key.

Unlock by Key Mechanism (FIG. 16A-16B):

The padlock 10 also contains the key locking mechanism 130 which is controlled by the cylinder 150. A cylinder retaining pin 230 is assembled into the cylinder 150 to prevent the cylinder 150 from falling out of the lock body 20. When there is no key 140 (i.e., no correctly cut key) inserted into the cylinder 150, rotation of the cylinder 150 is restricted. The cylinder 150 contains a fork 151, which will engage to the slot 161 of the cam 160, which makes the cylinder 150 and the cam 160 have the same rotational movement. In the lock mode (See FIG. 1B), the cam 160 cannot be turned, and the locking ball 170 is in contact with the locking surface 163 of the cam 160. This causes the groove 41 of the key-cable-end 40 to remain in locking position, which prevents one from pulling the key-cable-end 40 to open the padlock 10.

In the unlocked by key mechanism mode, as a correct key 140 is inserted in the cylinder 150, the cylinder 150 rotates and the cam 160 rotates in the same manner. As the cam 160 turns, the flat-side 162 of the cam 160 is aligned with the locking ball 170 and the locking ball 170 is allowed to move toward the flat-side 162 of the cam 160. As the user pulls the key-cable-end 40, the groove 41 of the key-cable-end 40 will contact the locking ball 170 and the locking ball 170 will move toward the flat-side 162 of the cam 160. As the locking ball 170 moves away from the groove 41 of the key-cable-end 40, the user can release the key-cable-end 40 out of the key-side locking hole 23 and out of the lock body 20.

To relock, the user can simply push the key-cable-end 40 to the key-side locking hole 23 of the lock body 20 and rotate the cylinder 150 to locked position which causes the locking ball 170 to contact the locking surface 163 of the cam 160, engaging the locking ball 170 back to the groove 41 of the key-cable-end 40. The user can then withdraw the key 140 and the padlock 10 is now in locked position.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention.

What is claimed:

1. A padlock having a combination locking mechanism and a key locking mechanism, and comprising:

i) a lock body;

ii) a cable connected to a combination side cable end and a key side cable end;

iii) a spindle to control the locking and unlocking of the combination locking mechanism independent of the key locking mechanism;

iv) more than one clutch mounted on the spindle which control the vertical movement of the spindle;

v) more than one dial mounted in the lock body, each having an opening slot and faulty notches;

vi) a bolt in contact with the combination side cable end, wherein movement of the bolt is controlled by movement of the spindle;

vii) a cam comprising a slot; and viii) a cylinder comprising a fork to contact the slot of the cam such that the rotational movement of the cylinder transfers to the cam;

wherein the spindle further comprises:

a top portion which contacts a neck of the bolt;

a threaded end to receive a threaded end of a reset button; and a hole to receive a bail to hold the spindle and reset button together to allow the reset button to unwind partially out of the lock body and to allow the user to pull a knob area of the reset button away from the spindle during a combination reset mode.

2. The padlock according to claim 1, wherein the opening slot of each dial receives an extended fin of one of the more than one clutch.

3. The padlock according to claim 2, wherein the lock body further comprises a number of slots to receive the extended fin of the clutch, wherein the number of slots in the lock body is equal to a number of indicia on each dial.

4. The padlock according to claim 1, wherein the bolt has a tip area which contacts a groove of the combination side cable end.

5. The padlock according to claim 4, wherein the bolt further comprises a neck which contains a slope contacting a top portion of the spindle.

6. The padlock according to claim 5, wherein the horizontal movement of the bolt is controlled by the relationship between the slope of the bolt and the top portion of the spindle.

7. The padlock according to claim 5, wherein the horizontal movement of the bolt is controlled by the movement of the spindle, such that if the clutch and dial are in a locked position, the spindle is in a locked position and the spindle and bolt will have no movement and will lock the bolt and the combination side end cable together, and if an extended fin of the clutch aligns with the opening slot of the dial, then the spindle is in an open position and can move vertically and allow the bolt to move horizontally to disengage with the groove of the combination side cable end.

8. The padlock according to claim 7, wherein the cam has a flat side and wherein if the flat side of the cam aligns with the ball, then the ball can move toward the flat side and allow a groove of the key side cable end to disengage and release the cable end.

9. The padlock according to claim 8, wherein the cam further comprises a round side which prevents movement of the ball and will-forces the ball to engage with the groove of the key side cable end.

* * * * *